US008056756B2

(12) United States Patent
Okiyama

(10) Patent No.: US 8,056,756 B2
(45) Date of Patent: Nov. 15, 2011

(54) COMMUNICATION MEMBER AND MEDICAL CONTAINER USING THE SAME

(75) Inventor: Tadashi Okiyama, Hiroshima (JP)

(73) Assignee: JMS Co., Ltd., Hiroshima (JP)

( * ) Notice: Subject to any disclaimer, the term of this patent is extended or adjusted under 35 U.S.C. 154(b) by 301 days.

(21) Appl. No.: 12/445,888

(22) PCT Filed: Oct. 17, 2007

(86) PCT No.: PCT/JP2007/070269

§ 371 (c)(1),
(2), (4) Date: Apr. 16, 2009

(87) PCT Pub. No.: WO2008/050655

PCT Pub. Date: May 2, 2008

(65) Prior Publication Data

US 2010/0288722 A1 Nov. 18, 2010

(30) Foreign Application Priority Data

Oct. 17, 2006 (JP) ..... 2006-282928

(51) Int. Cl.
*B65D 41/00* (2006.01)

(52) U.S. Cl. ..... 220/724; 137/68.29; 604/167.03; 604/244; 604/905

(58) Field of Classification Search ..... 220/724, 220/229; 604/415, 905, 167.01–167.06, 604/246; 215/247; 137/68.3, 68.29
See application file for complete search history.

(56) References Cited

U.S. PATENT DOCUMENTS

| | | | | |
|---|---|---|---|---|
| 5,147,065 | A * | 9/1992 | Rush et al. | 220/709 |
| 5,342,316 | A * | 8/1994 | Wallace | 604/167.02 |
| 5,853,094 | A | 12/1998 | Tanaka et al. | |
| 5,871,110 | A | 2/1999 | Grimard et al. | |
| 6,213,322 | B1 * | 4/2001 | Schwallie et al. | 215/253 |
| 6,352,520 | B1 | 3/2002 | Miyazaki | |

(Continued)

FOREIGN PATENT DOCUMENTS

| | | |
|---|---|---|
| JP | 2-28916 | 8/1990 |

(Continued)

*Primary Examiner* — Mickey Yu
*Assistant Examiner* — Rafael Ortiz
(74) *Attorney, Agent, or Firm* — Hamre, Schumann, Mueller & Larson, P.C.

(57) ABSTRACT

The present invention provides a communication member for a medical container capable of allowing communication between the inside and the outside of a container body containing a liquid in a state of being fixed to the container body. The communication member includes: a valve 2 having an insertion hole 2*a*; a tubular body 3 supporting the valve 2; and a closing film 4 for closing a bore of the tubular body 3 in the bore and in the vicinity of the valve 2. The tubular body 3 and the closing film 4 are molded integrally. A groove 4*a* that passes through the center of the closing film 4 is formed on either a surface of the closing film 4 on the valve 2 side or a surface opposite to the valve side. A pair of ribs 4*b* are formed on a surface opposite to a surface of the closing film 4 on which the groove is formed, and one of the pair of ribs is formed on one of the two areas that are divided by a straight line whose longitudinal direction is the same as that of the groove and that passes through the center of the closing film, and the other rib is formed on the other area.

14 Claims, 12 Drawing Sheets

U.S. PATENT DOCUMENTS

| | | | | |
|---|---|---|---|---|
| 6,568,439 | B1 | 5/2003 | Se et al. | |
| 7,766,168 | B2 * | 8/2010 | Thrapp et al. | 206/496 |
| 2001/0000347 | A1 * | 4/2001 | Hellstrom et al. | 604/415 |
| 2002/0104791 | A1 * | 8/2002 | Hahmann et al. | 210/232 |
| 2004/0035816 | A1 | 2/2004 | Okiyama | |
| 2004/0267228 | A1 | 12/2004 | Hattori et al. | |
| 2005/0027261 | A1 * | 2/2005 | Weaver et al. | 604/246 |
| 2005/0215943 | A1 * | 9/2005 | Brandenburger et al. | 604/30 |
| 2006/0226113 | A1 * | 10/2006 | Clark et al. | 215/247 |
| 2009/0076456 | A1 * | 3/2009 | Armstrong et al. | 604/167.06 |

FOREIGN PATENT DOCUMENTS

| | | |
|---|---|---|
| JP | 8-317961 | 12/1996 |
| JP | 10-118158 | 5/1998 |
| JP | 11-299898 | 11/1999 |
| JP | 2003-159313 | 6/2003 |
| JP | 2004-248892 | 9/2004 |
| JP | 2004-283519 | 10/2004 |
| JP | 2005-028041 | 2/2005 |
| WO | 00/63088 | 10/2000 |
| WO | 02/45648 | 6/2002 |

* cited by examiner

COMMUNICATION MEMBER AND MEDICAL CONTAINER USING THE SAME

TECHNICAL FIELD

The present invention relates to a communication member that constitutes an opening of a medical container containing a liquid such as a drug solution; and a medical container using the communication member.

BACKGROUND ART

Examples of medical containers include a medical container containing a drug solution for an intravenous drip, a medical container containing a nutritional supplement (also called "high-calorie infusion solution") supplied to the central vein, and the like. These medical containers are composed of a container body made of a flexible sheet material and a liquid discharge port provided for discharging the drug solution or the like present in the container body out of the container body.

The liquid discharge port is composed of a tube that is welded and fixed to the container body by being sandwiched by a sheet material, a sealing member that seals an end of the tube located outside the container body, and the like. A plug into which a metal injection needle, a resin introducer needle or the like can be inserted is used as the material for the sealing member. The plug is made of, for example, a synthetic rubber or a thermoplastic elastomer. The tube is a relatively-hard molded product made of plastic, for example.

Patent Document 1: JP H08-317961 A

DISCLOSURE OF INVENTION

Problem to be Solved by the Invention

However, when a puncturing member with a sharp tip such as a metal injection needle or a resin intruder needle is used, there is a risk that the drug solution may be contaminated with chips that are chipped away from the plug when puncturing the plug with the puncturing member. Further, the use of the puncturing member with a sharp tip always is accompanied by a danger of accidental punctures.

Therefore, it may be considered that a valve into which an insertion member without a sharp tip can be inserted is used as the sealing member instead of the plug. An insertion hole that passes through the valve in its thickness direction is formed in advance. Thus, when storing the drug solution or the like, it is necessary to prevent the drug solution from coming into contact with outside air or a leakage of the drug solution from the container through the insertion hole. Furthermore, when the drug solution or the like is stored in a state of being in contact with the sealing member, there is a risk that some parts of the sealing member may be eluted into the drug solution or the like.

With the foregoing in mind, the present invention provides a communication member for a medical container that can prevent the contamination of a liquid such as a drug solution with chips and accidental punctures, has excellent stability in storing the drug solution or the like, can be produced easily, and can communicate with an insertion member with an adequate force; and a medical container using the communication member.

Means for Solving Problem

The communication member for a medical container of the present invention is a communication member for a medical container capable of allowing communication between the inside and the outside of a container body containing a liquid in a state of being fixed to the container body. The communication member includes: a disc-shaped valve having an insertion hole; a tubular body supporting the valve; and a closing film for dosing a bore of the tubular body in the bore and in the vicinity of the valve. The tubular body and the dosing film are molded integrally. A groove that passes through a center of the dosing film is formed on either a surface of the dosing film on a valve side or a surface opposite to the valve side. A pair of ribs are formed on a surface opposite to a surface of the dosing film on which the groove is formed. One of the pair of ribs is formed on one of the two areas that are divided by a straight line whose longitudinal direction is same as that of the groove and which passes through the center of the closing film, and the other rib is formed on the other area.

Further; the communication member for a medical container of the present invention is a communication member for a medical container capable of allowing communication between the inside and the outside of a container body containing a liquid in a state of being fixed to the container body. The communication member includes: a disc-shaped valve having an insertion hole; a tubular body supporting the valve; and a closing film for closing a bore of the tubular body in the bore and in the vicinity of the valve. The tubular body and the closing film are molded integrally. A groove that passes through a center of the closing film is formed on either a surface of the closing film on a valve side or a surface opposite to the valve side. A plurality of ribs are formed on a surface opposite to a surface of the closing film on which the groove is formed, and between both ends of each of the ribs, a tip of an end that is closer to the center of the closing film is in the vicinity of the center of the closing film or located at the center. Each of the ribs is formed along a straight line that passes through the center of the closing film and has a predetermined angle with respect to a longitudinal direction of the groove, and the plurality of ribs are disposed at an equal angular interval in a circumferential direction of the closing film.

The medical container of the present invention includes: a container body; the communication member of the present invention being fixed to the container body and allowing communication between the inside and the outside of the container body; and a liquid present in the container body.

DESCRIPTION OF THE INVENTION

Figure 1:
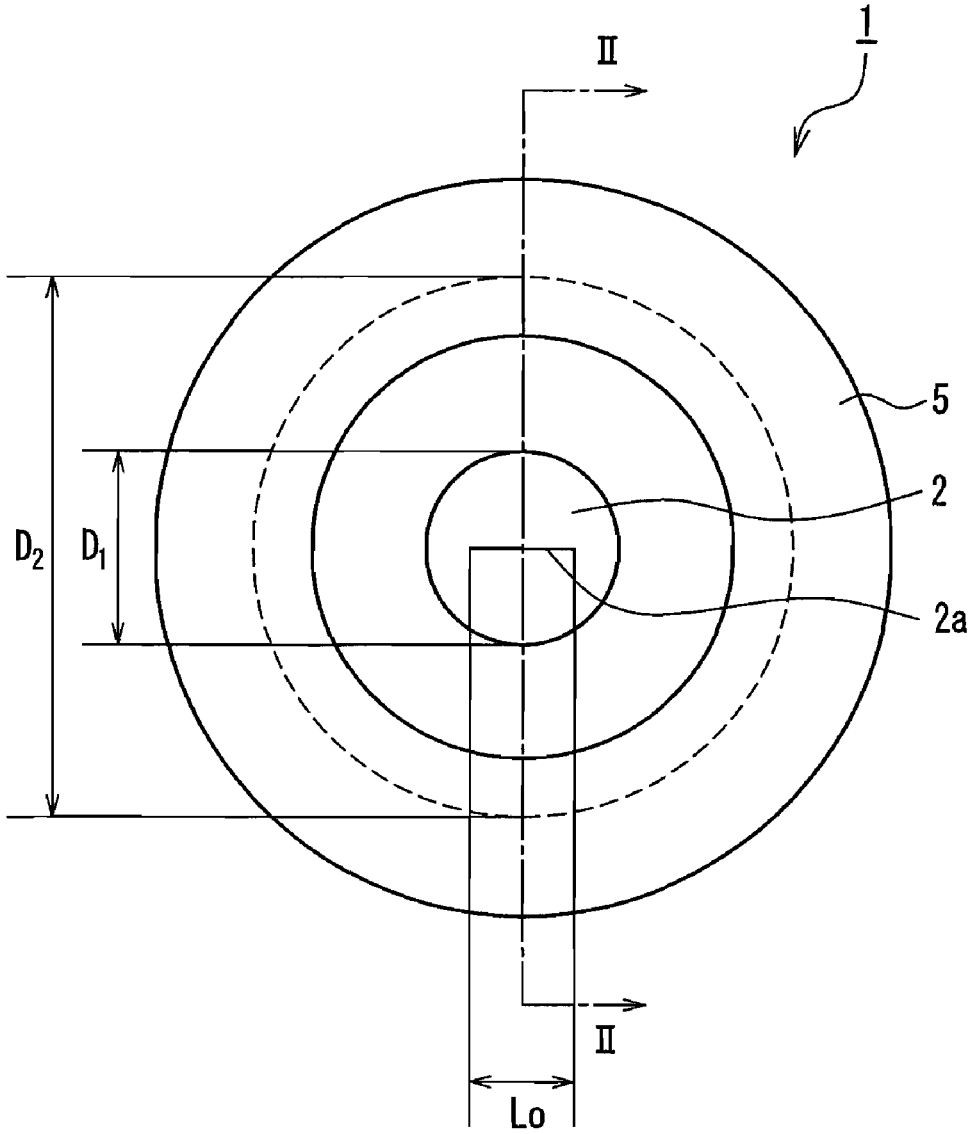
FIG. 1 is a plan view showing one example of the communication member of the present invention.

In one preferred example of the communication member for a medical container of the present invention, each of the pair of ribs is formed along a straight line that passes through the center of the dosing film and has a predetermined angle with respect to the longitudinal direction of the groove.

In one preferred example of the communication member for a medical container of the present invention, the groove has a width that decreases as it get closer to the bottom. In a particularly preferred example, the cross-sectional shape of the groove in its width direction at the bottom is V-shaped.

In one preferred example of the communication member for a medical container of the present invention, the communication member further includes a cover member that interposes the valve together with the tubular body and covers a periphery of an outer surface of the valve.

In one preferred example of the communication member for a medical container of the present invention, the pair of ribs are formed symmetrically with respect to the center of the dosing film.

In one preferred example of the communication member for a medical container of the present invention, between both end portions of each of the ribs, a tip portion of an end portion that is closer to the center of the dosing film has a width that decreases as it gets closer to a tip, and the tip of each of the ribs is on a straight line whose longitudinal direction is the same as that of each of the ribs and which passes through the center of the dosing film. More preferably, the tip is pointed.

In one preferred example of the communication member for a medical container of the present invention, the tip of the end of each of the ribs that is closer to the center of the dosing film is in the vicinity of the center of the closing film or located at the center, and more preferably the tips of the pair of ribs are coupled to each other at the center of the dosing film.

In one preferred example of the communication member for a medical container of the present invention, the pair of ribs are both formed along one straight line that passes through the center of the dosing film and has a predetermined angle with respect to the longitudinal direction of the groove. In this case, it is preferable that the straight line is orthogonal to the longitudinal direction of the groove.

In one preferred example of the communication member for a medical container of the present invention, the dosing film and the tubular body include at least one type of resin selected from a group consisting of polyethylene, polypropylene, cyclic polyolefin, polyethylene terephthalate, and polyvinyl chloride.

In one preferred example of the communication member for a medical container of the present invention, one or more arc-shaped grooves are formed on the periphery of the surface of the closing film on which the groove is formed. More preferably, at least one of the one or more arc-shaped grooves is coupled to the groove.

Next, the present invention will be described in more detail with reference to the drawings.

Embodiment 1

In Embodiment 1, one example of the communication member for a medical container of the present invention (hereinafter referred also to as simply "the communication member") and one example of the medical container using the communication member will be described.

Figure 2:
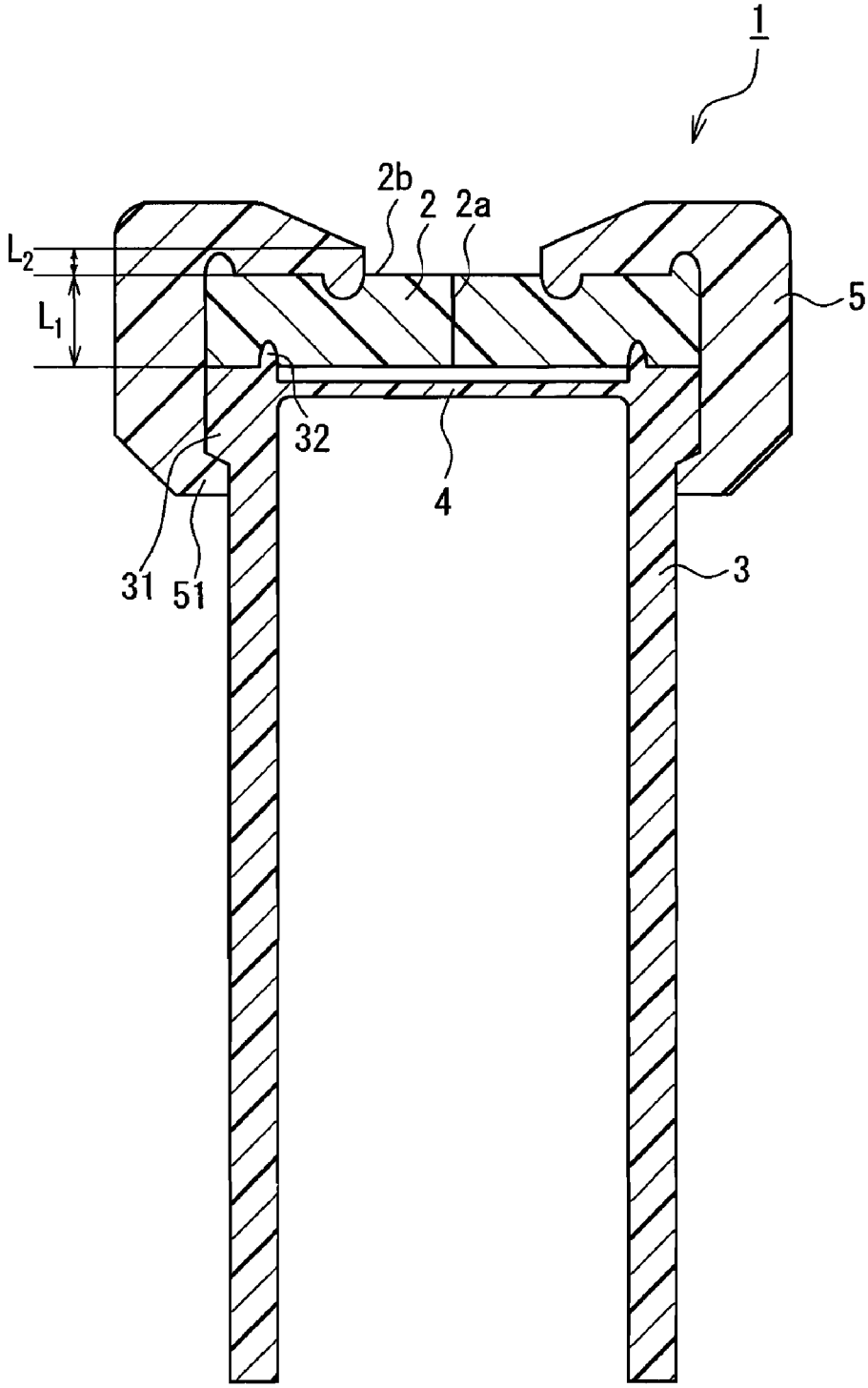
FIG. 2 is a cross-sectional view of the communication member shown in FIG. 1 taken along the line
Figure 3:
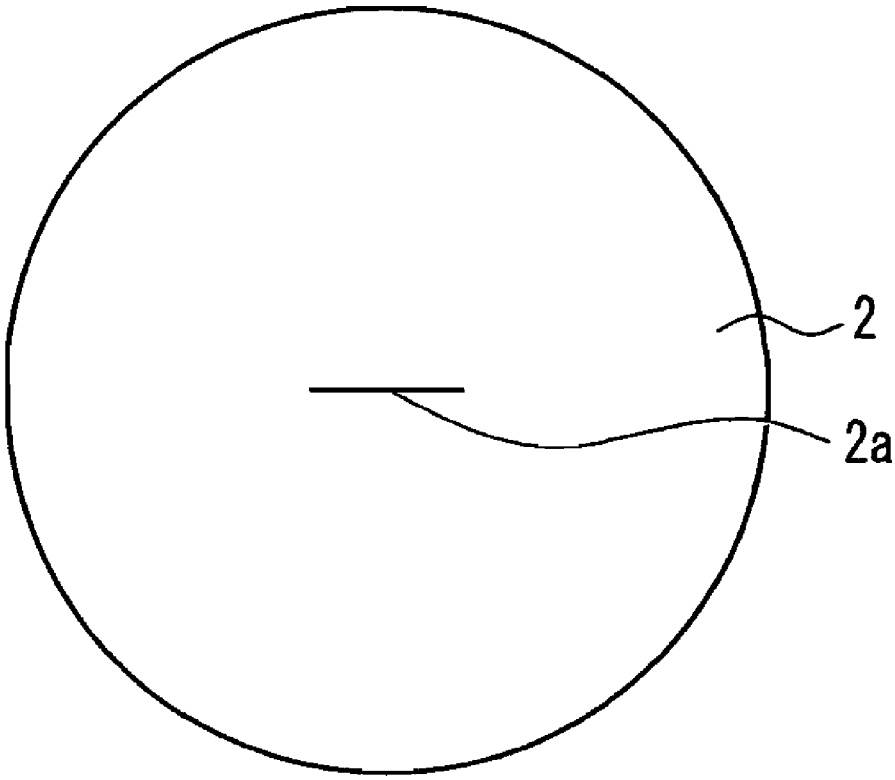
FIG. 3 is a plan view showing one example of a valve constituting the communication member shown in FIG. 1.
Figure 4:
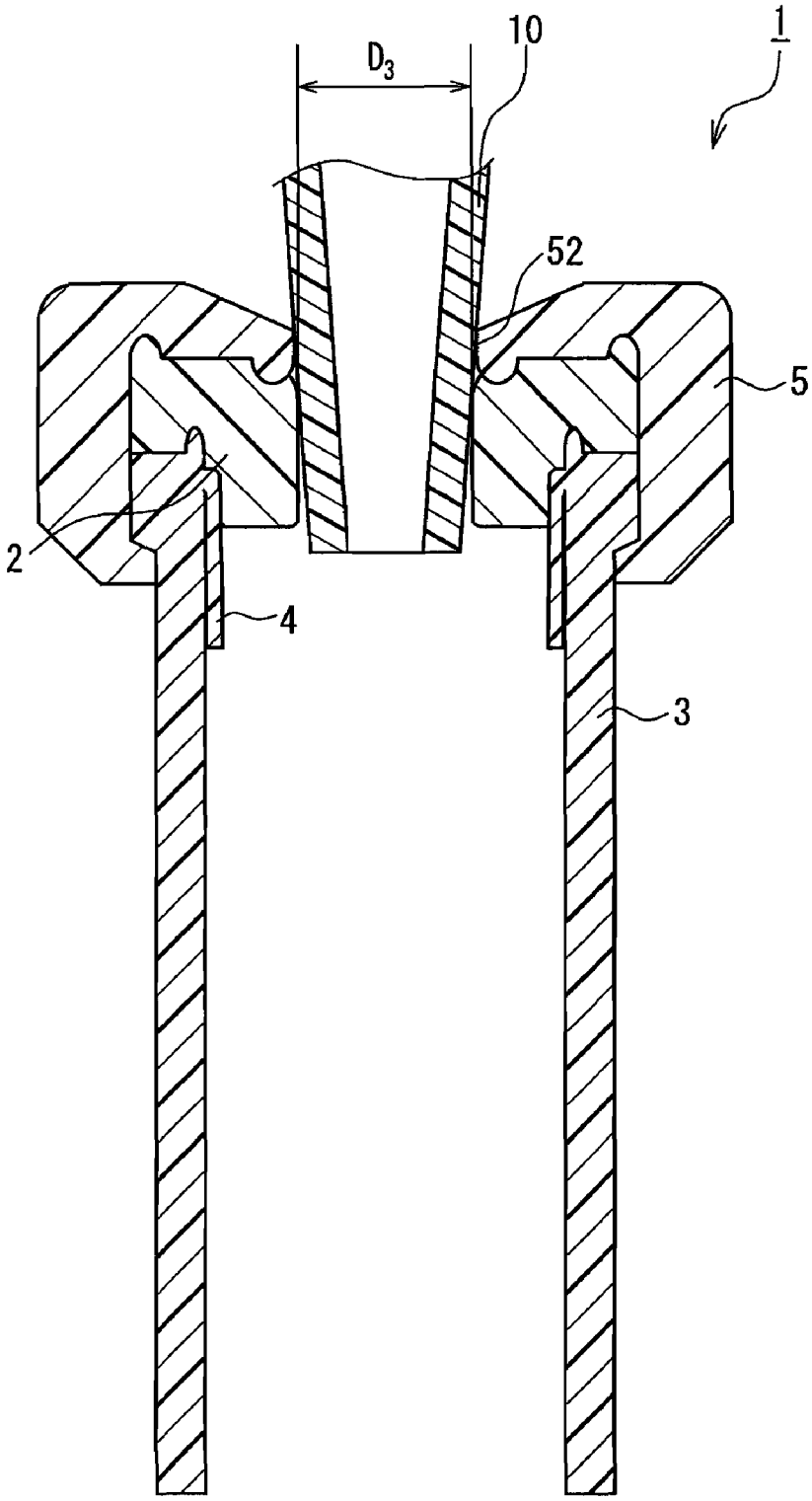
FIG. 4 is a cross-sectional view showing a state where an insertion member is inserted into the communication member shown in FIG. 2.
Figure 5:
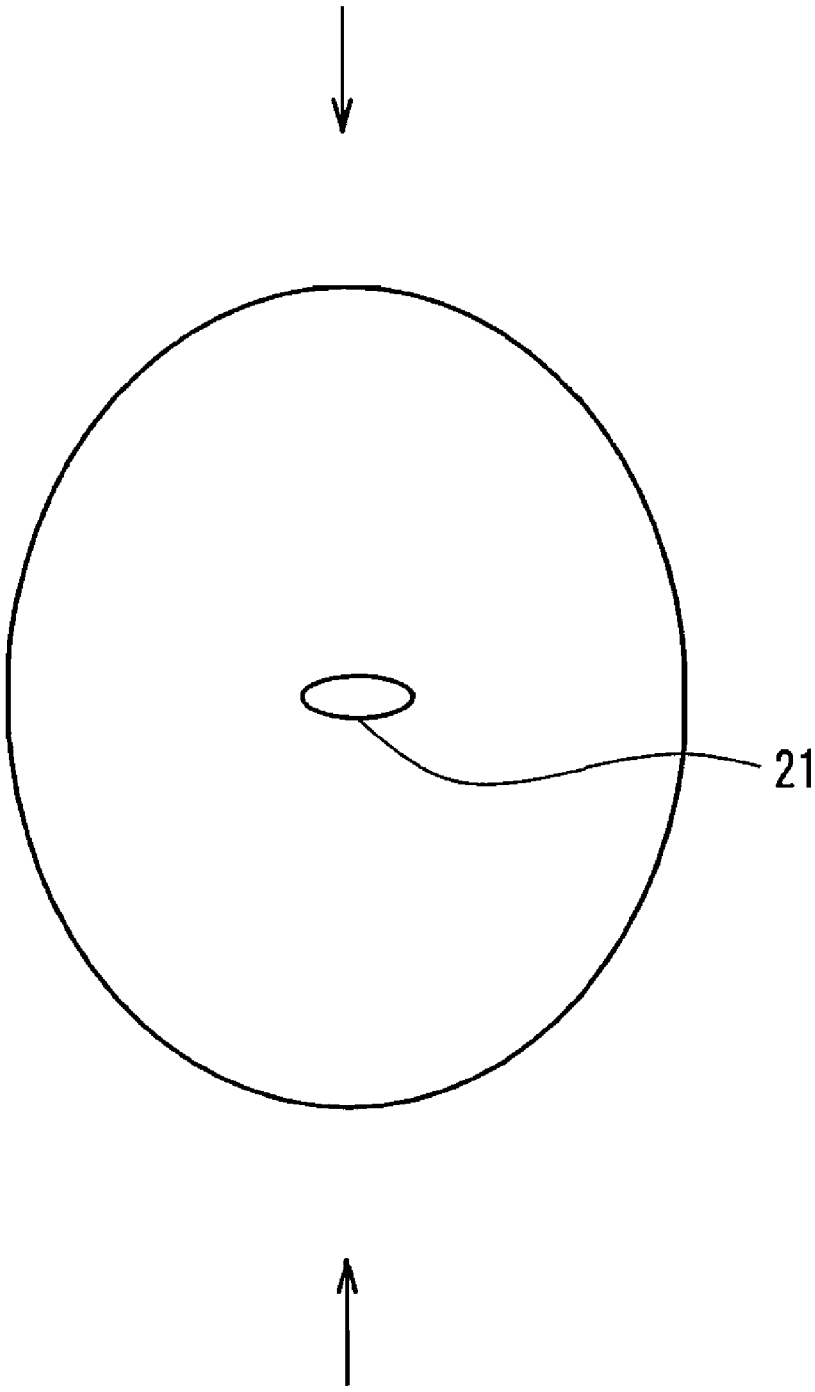
FIG. 5 is a plan view showing another example of the valve constituting the communication member shown in FIG. 1.
Figure 8:
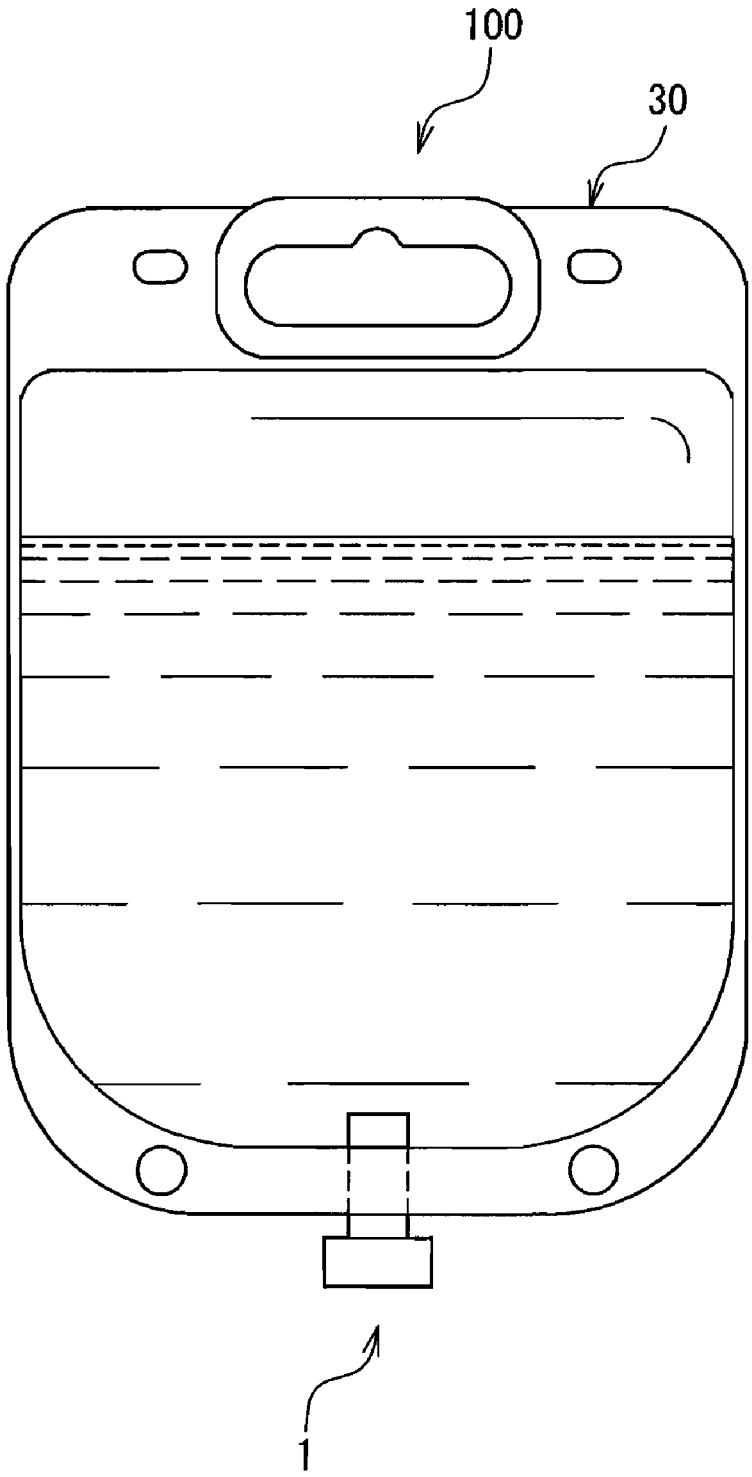
FIG. 8 is a plan view showing one example of the medical container of the present invention.

FIG. 1 is a plan view showing one example of the communication member of the present invention, and FIG. 2 is a cross-sectional view showing the communication member shown in FIG. 1 taken along the line II-II. FIG. 3 is a plan view showing one example of a valve constituting the communication member shown in FIG. 1, and FIG. 4 is a cross-sectional view showing a state where an insertion member is inserted into the communication member shown in FIG. 2. FIG. 5 is a plan view showing another example of the valve constituting the communication member shown in FIG. 1. FIG. 8 is a plan view showing one example of the medical container using one example of the communication member of the present invention.

As shown in FIG. 8, a communication member 1 according to the present embodiment constitutes a part of a medical container 100 containing a drug solution or the like in advance. The communication member 1 is fixed to a container body 30 made of a flexible sheet material.

As shown in FIGS. 1 and 2, the communication member 1, which is one example of the present invention, includes a disc-shaped valve 2, for example. The valve 2 has an insertion hole 2*a* that passes through the valve 2 in its thickness direction. As shown in FIG. 3, the insertion hole 2*a* is a slit that is formed by, for example, making an incision with a blade or the like in the disc-shaped elastic body whose surface shape is perfect circle. The length or the like of the slit is determined appropriately on the basis of the diameter or the like of an insertion member 10 (see FIG. 4) to be inserted into the slit.

As shown in FIG. 2, the valve 2 is placed on one end surface of a tubular body 3, and is supported by the tubular body 3. A closing film 4 for dosing the bore of the tubular body 3 is provided at a position that is within the bore of the tubular body 3 and in the vicinity of the valve 2 so as to block communication between the inside and the outside of the container body 30 (see FIG. 8). Even without the dosing film 4, contact between the drug solution or the like present in the container body and outside air or a leakage of the drug solution from the medical container are supposedly prevented by the valve 2. However, those problems can be prevented with more certainty by providing the closing film 4. The dosing film 4 is to be pierced through by the insertion member 10 (see FIG. 4) inserted into the insertion hole 2*a* when supplying the drug solution or the like present in the container body to the outside of the medical container It should noted that "the vicinity of the valve 2" refers to a position range in which the dosing film 4 can be pierced through with the insertion member 10 inserted into the insertion hole 2*a*. Thus, the dosing film 4 may be in contact with the valve 2, for example.

It is preferable that the material of the tubular body 3 is a rigid material so as to easily support the valve 2 together with a cover member 5, which will be described below. For example, it is preferable that the material is rigid plastic including resins, such as polypropylene, polyethylene, polycarbonate, and polyvinyl chloride. Since the dosing film 4 is molded integrally with the tubular body 3 using the following method, the material of the dosing film 4 is naturally the same as that of the tubular body 3.

Examples of the method of molding the tubular body 3 and the dosing film 4 include an injection molding method.

As shown in FIG. 2, the valve 2 is covered with the cover member 5 at the periphery of its outer surface (the surface opposite to the surface facing the tubular body 3) and its side surface. The valve 2 is interposed between the cover member 5 and the tubular body 3. Further, the cover member 5 and the valve 2 are fixed firmly to the tubular body 3 by, for example, an engagement between a hook portion 51 of the cover member 5 and a protrusion 31 of the tubular body 3. Since a center portion 2*b* on which the insertion hole 2*a* is formed is exposed in the outer surface of the valve 2, the insertion member 10, such as a male luer as defined by ISO594-1 or ISO594-2, can be inserted into the slit 2*a* of the valve 2 (see FIG. 4).

It should be noted that, as shown in FIG. 5, the insertion hole 2*a* may be a slit formed by, for example, applying a pressure in the directions of the arrows to an elastic body with an elliptic surface shape on which an elliptic hole 21 is formed, so as to dose the elliptic hole 21.

Next, one example of the dosing film 4 will be described with reference to FIGS. 6 to 7.

Figure 6A:
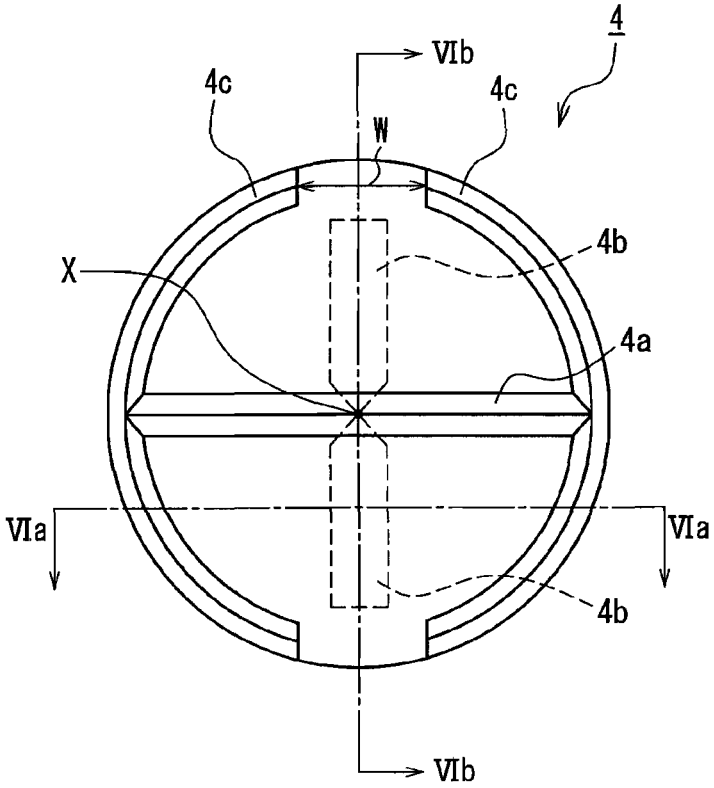
FIG. 6A is an enlarged plan view showing a closing film constituting the communication member shown in FIG. 1 from the valve side.
Figure 6C:
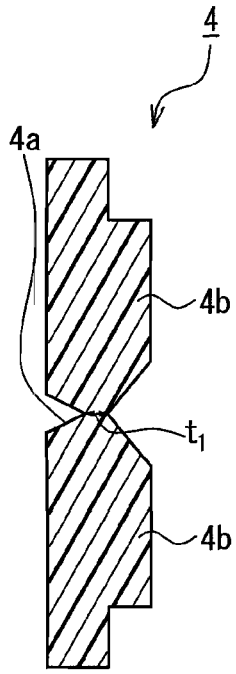
FIG. 6C is a cross-sectional view along the line VIb-VIb in FIG. 6A.

FIG. 6A is an enlarged plan view showing the dosing film constituting the communication member shown in FIG. 1 from the valve side. FIG. GB is a cross-sectional view along the line VIa-VIa in FIG. 6A, and FIG. 6C is a cross-sectional view along the line VIb-VIb in FIG. 6A. FIG. 7 is an enlarged plan view showing the dosing film constituting the communication member shown in FIG. 1 from the surface opposite to the valve side. It should be noted that in order to make the present invention easier to understand, the thickness of the dosing film 4 in FIGS. 6B and 6C differs from the actual size.

Figure 6B:
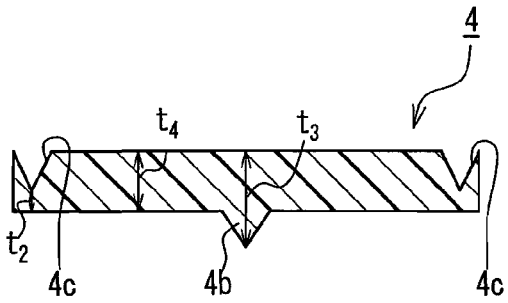
FIG. 6B is a cross-sectional view along the line VIa-VIa in FIG. 6A.
Figure 7:
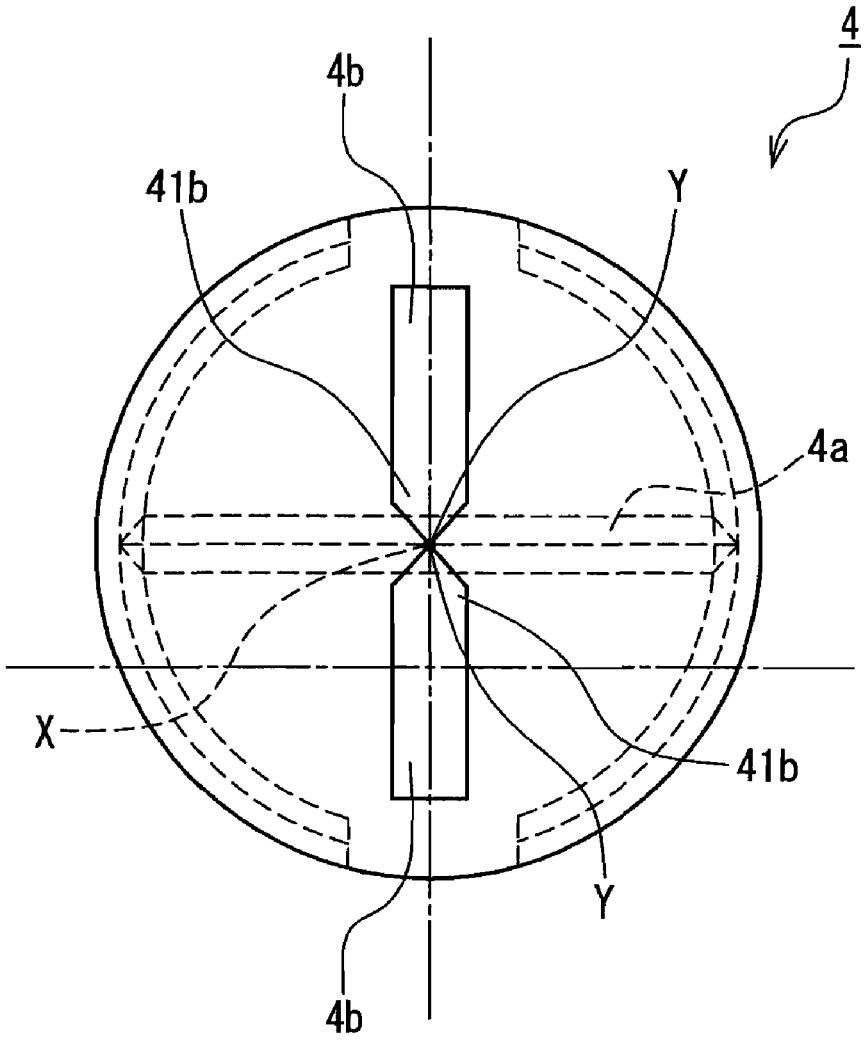
FIG. 7 is an enlarged plan view showing the dosing film constituting the communication member shown in FIG. 1 from a surface opposite to the valve side.

As shown in FIGS. 6 to 7, a groove 4*a* that passes through the center X is formed on the surface of the dosing film 4 on the valve side. Furthermore, a pair of ribs 4*b* disposed to interpose the groove 4*a* are formed on the surface of the dosing film 4 opposite to the valve-side surface. That is, one of the pair of ribs 4*b* is formed on one of the two areas that are divided by a straight line whose longitudinal direction is same as that of the groove 4*a* and that passes through the center of the dosing film 4, and the other rib 4*b* is formed on the other area. Thus, when the insertion member 10 (see FIG. 4) inserted into the insertion hole 2*a* (see FIG. 2) imposes a load on the dosing film 4, a stress generated within the dosing film 4 concentrates at a position that is between the pair of ribs 4*b* and in the vicinity of the center X. Therefore, even when the dosing film 4 is a relatively rigid plastic molded product, it is possible to pierce easily through the dosing film 4 with the insertion member 10 that has no sharp tip like a luer or the like. It should be noted that in the example shown in FIGS. 6 to 7, the pair of ribs 4*b* are disposed substantially symmetrically with respect to the center X. However, it is not essential to dispose the pair of ribs 4*b* disposed to interpose the groove 4 symmetrically as long as the stress concentrates in the vicinity of the center X.

As shown in FIG. 7, between both ends of each of the ribs 4*b*, an end 41*b* that is closer to the center X has a width that decreases as it gets closer to a tip Y. It is further preferable that the tip Y is pointed since the pressure is more likely to concentrate at the center X. Furthermore, it is preferable that the tips Y of the ribs 4*b* are both in the vicinity of the center X or are located at the center X. It is particularly preferable that the tips Y of the ribs 4*b* both are located at the center X and are coupled to each other at the center X of the closing film 4 since the stress is more likely to concentrate in the vicinity of the center X, and thereby the closing film 4 can be pierced through more easily with the insertion member 10 (see FIG. 4).

It should be noted that in the example shown in FIGS. 6 to 7, the groove 4*a* has a depth that is substantially constant along the longitudinal direction of the groove 4*a*, and in the dosing film 4, the thickness of the portion of the groove 4*a* at the center X is equal to the thickness of other portions of the groove 4*a*. However, if the dosing film 4 is molded such that the thickness of the portion of the groove 4*a* in the vicinity of the center X is smaller than that of the remaining portions, it is preferable since the dosing film 4 can be pierced through more easily with the insertion member 10 (see FIG. 4).

Further, as shown in FIG. 7, it is preferable that each of the ribs 4*b* is formed along a line that passes through the center X and is orthogonal to the groove 4*a*. In other words, it is preferable that a straight line whose longitudinal direction is same as that of each of the ribs 4*b* and which passes through the center X and has a predetermined angle with respect to the longitudinal direction of the groove 4*a* is orthogonal to the longitudinal direction of the groove 4*a*. This is because when ripping starts from the vicinity of the center X, it is likely to propagate toward the periphery of the dosing film 4 along the groove 4*a*.

As shown in FIGS. 6A and 6B, it is further preferable that one or more arc-shaped grooves 4*c* are formed on the periphery of the surface of the closing film 4 on the valve 2 side. Furthermore, it is preferable that at least one of the one or more arc-shaped grooves 4*c* is coupled to the groove 4*a*. When the number of the arc-shaped grooves 4*c* formed on the periphery is two or more, it is preferable that they are formed along the circumference of the dosing film 4 at an equal interval. It is preferable that a space W between the adjoining arc-shaped grooves 4*c* in the circumferential direction has such a length that some parts of the ripped dosing film 4 do not fall off. In this case, since ripping that started from the vicinity of the center X may propagate further along the arc-shaped grooves 4*c* after reaching the periphery of the dosing film 4, the insertion resistance of the insertion member 10 (see FIG. 4) is reduced further.

Although the number of the arc-shaped grooves 4*c* is not particularly limited, it is preferable that the number of the arc-shaped grooves is two as shown in FIG. 6A when the number of the groove 4*a* is one, and the two arc-shaped grooves 4*c* are preferably both coupled to the groove 4*a*. In this case, it is possible to reduce the insertion resistance of the insertion member 10 (see FIG. 10) while allowing a sufficient length for the space W between the arc-shaped grooves 4*c*. When the space W between the arc-shaped grooves 4*c* has a sufficient length, it is possible to prevent some parts of the dosing film 4 from falling off or the like. Furthermore, it is preferable that the groove 4*a* is coupled to the arc-shaped grooves 4*c* in the vicinity of the center of the longitudinal direction of the arc-shaped grooves 4*c*. In this case, further reduction in the insertion resistance of the insertion member 10 can be expected.

Figure 11:
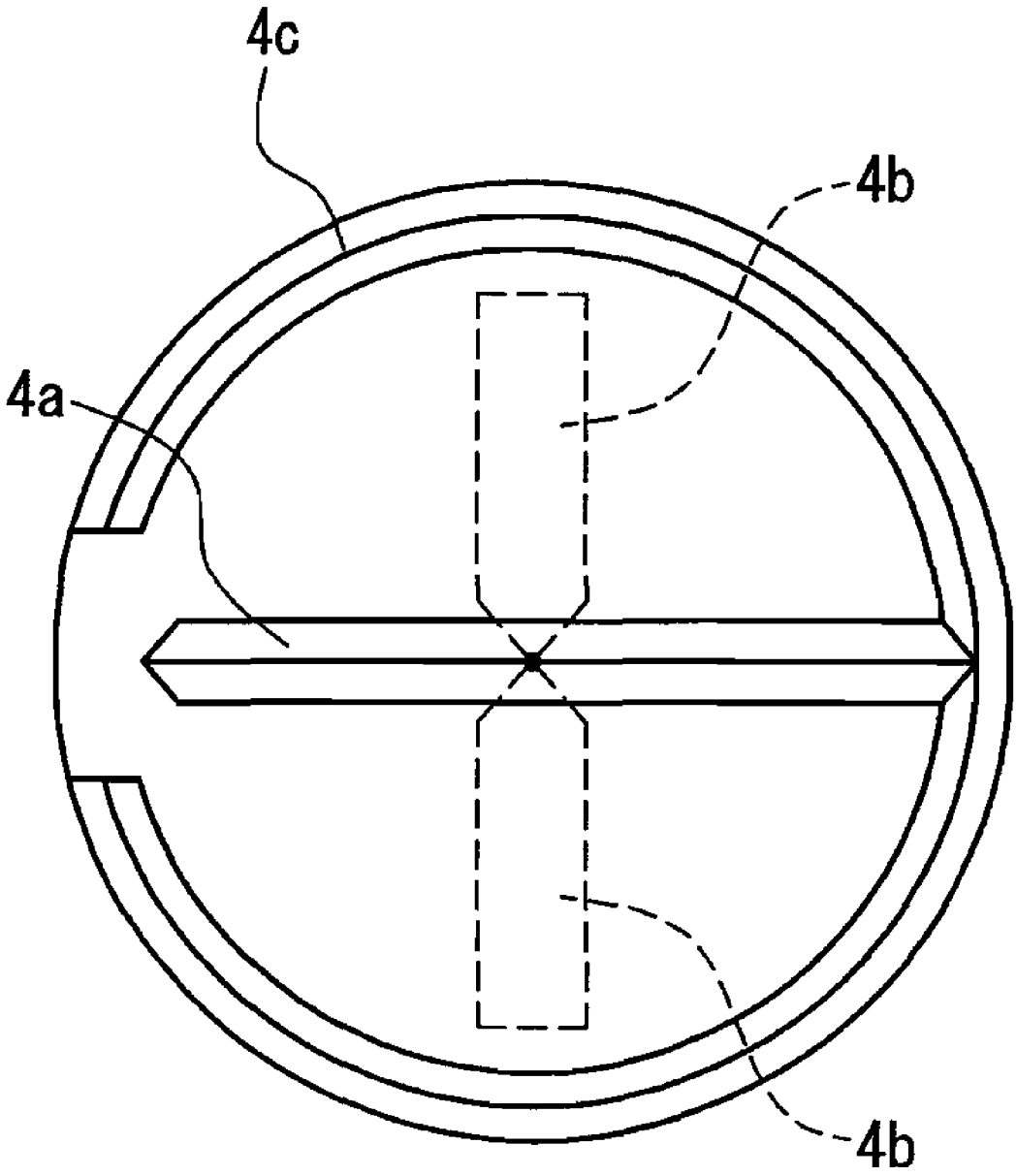
FIG. 11 is an enlarged plan view showing yet another example of the dosing film constituting the communication member shown in FIG. 1 from the valve side.

When the number of the arc-shaped groove 4*c* is one, as shown in FIG. 11, only one end of the groove 4*a* may be coupled to the arc-shaped groove 4*c* so as to prevent some parts of the closing film 4 from falling off.

The groove 4*a*, the ribs 4*b*, and the arc-shaped groove 4*c* are formed when the dosing film 4 is molded integrally with the tubular body 3. Thus, the communication member 1 including the dosing film 4 can be produced without increasing the number of the steps. Furthermore, since a conventionally known molding method can be used, the production is easy.

The cross-sectional shape of the groove 4*a* in its width direction is not particularly limited, and it may be U-shaped, semicircular, concave, or the like. However, it is preferable that the groove 4*a* has a width that decreases as it gets closer to the bottom so as to allow the stress to concentrate in the vicinity of the center X, and it is particularly preferable that the cross-sectional shape of the groove 4*a* in the width direction is V-shaped.

Examples of the cross-sectional shape of the ribs 4*b* in the width direction include inverse-triangular, semicircular, square, and the like.

Figure 9A:
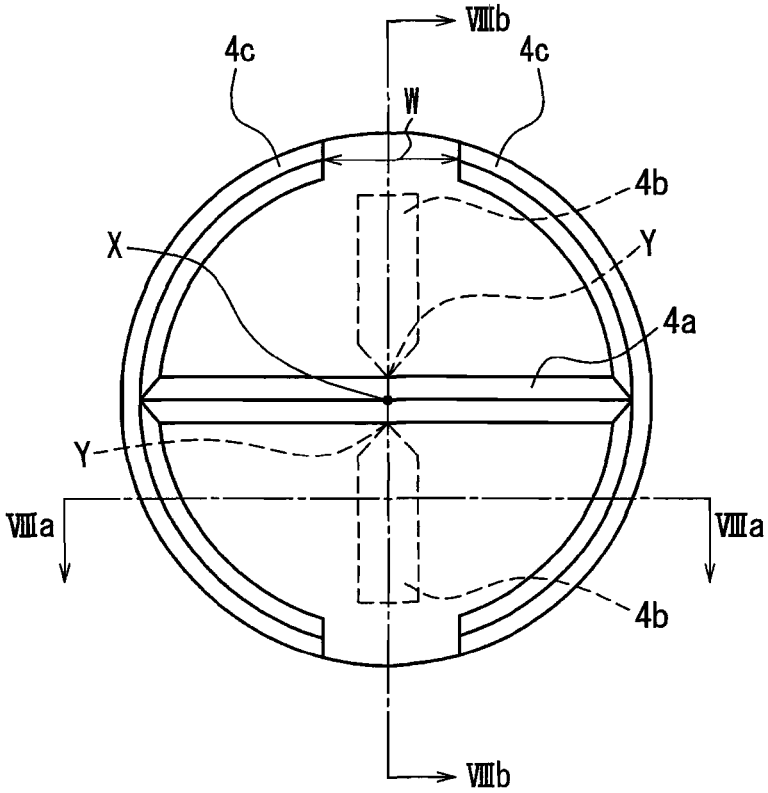
FIG. 9A is an enlarged plan view showing another example of the dosing film constituting the communication member shown in FIG. 1 from the valve side.

Although one example of the closing film 4 that constitutes the communication member according to the present embodiment has been described with reference to FIGS. 6 to 7, the dosing film that constitutes the communication member of the present invention is not limited to this example. For example, as long as the effects of the present invention can be obtained, the tips Y of the ribs 4*b* may be spaced apart from each other as shown in FIG. 9A. Even in this case, since the stress concentrates on a line that links each of the tips Y and the center X, the closing film 4 can be pierced through easily with the insertion member 10 (see FIG. 4). Although the space between the tips Y of the ribs 4*b* varies from material to material of which the dosing film 4 is made, it is preferable that the space is 3 nun or less, and as shown in FIG. 6A, it is particularly preferable that the space is 0 mm. It should be noted that in order to make the present invention easier to understand, the thickness of the dosing film 4 differs from the actual size.

Figure 10:
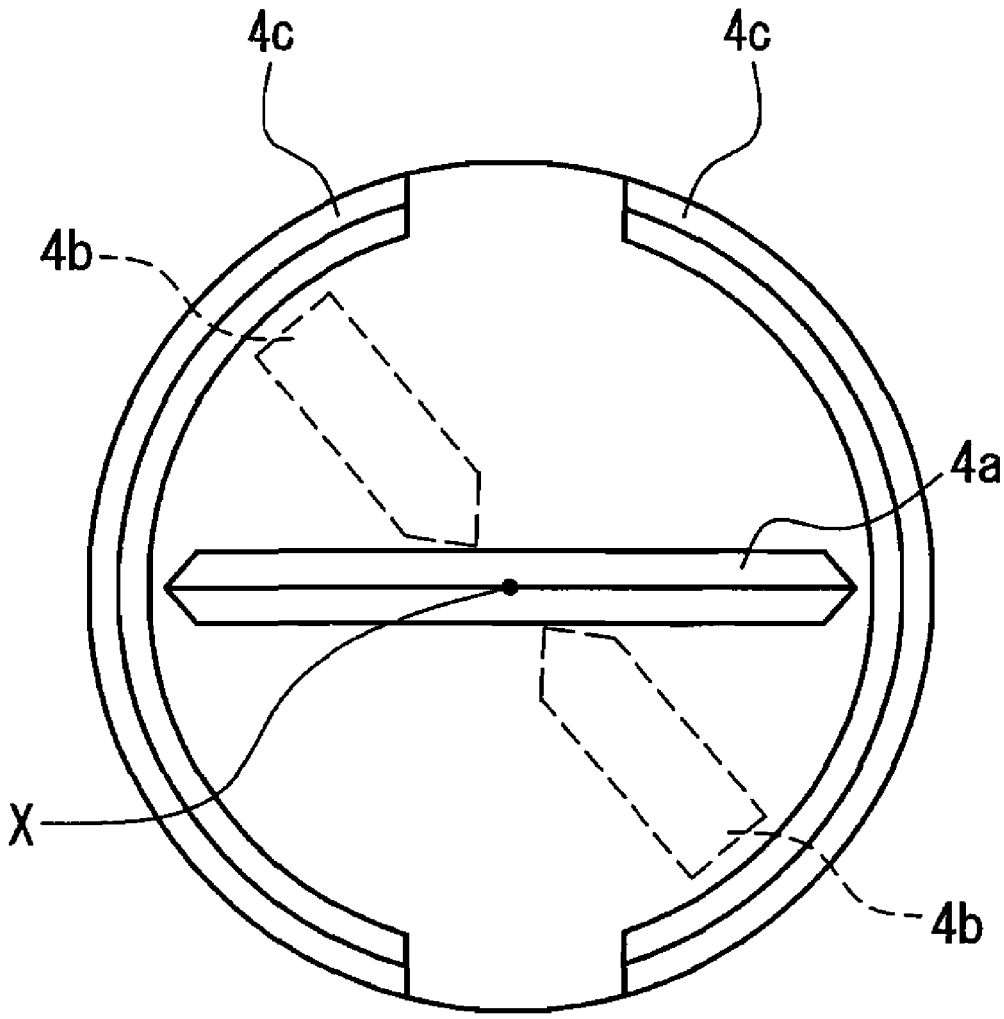
FIG. 10 is an enlarged plan view showing yet another example of the dosing film constituting the communication member shown in FIG. 1 from the valve side.

Further, it is preferable that the straight line whose longitudinal direction is same as that of each of the ribs 4*b* and which passes through the center X is orthogonal to the longitudinal direction of the groove 4*a* since the stress is likely to concentrate on a straight line that links the tips Y of the pair of ribs. However, as shown in FIG. 10, the straight line whose longitudinal direction is same as that of each of the ribs 4*b* and which passes through the center X may be tilted. Further, the groove 4*a* need not be coupled to the arc-shaped groove 4*c*, and the arc-shaped groove 4*c* need not be provided.

Figure 9C:
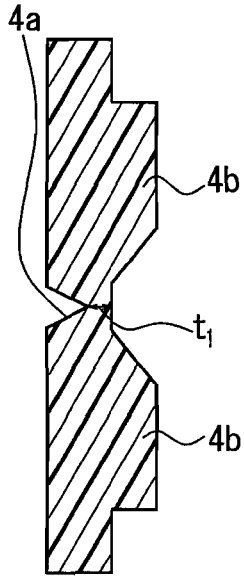
FIG. 9C is a cross-sectional view along the line VIIIb-VIIIb in FIG. 9A

As shown in FIGS. 6C and 9C, although the smallest thickness $t_1$ (the thickness of the dosing film 4 at the center X) of the dosing film 4 at the portion on which the groove 4*a* is formed varies from material to material of which the dosing film 4 is made, it is preferable that the thickness is from 0.1 to 0.5 mm. This is because too large thickness results in an increase in a penetration resistance and too small thickness makes molding of the film difficult by using an intrusion molding method.

Figure 9B:
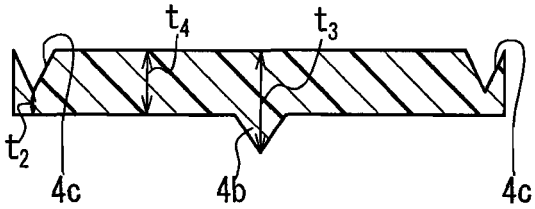
FIG. 9B is a cross-sectional view along the line VIIIa-VIIIa in FIG. 9A.

As shown in FIGS. 6B and 9B, although the smallest thickness $t_2$ of the dosing film 4 at the portions on which the arc-shaped grooves 4*c* are formed varies from material to material of which the dosing film 4 is made, it is preferable that the thickness is from 0.1 to 0.5 mm. This is because too large thickness results in an increase in a penetration resistance and too small thickness makes molding of the film difficult by using an intrusion molding method.

The largest thickness $t_3$ of the closing film 4 at the portions on which the ribs are formed is not particularly limited as long as the effects due to providing the ribs 4*b* are obtained.

Although a thickness $t_4$ of the closing film 4 at the portion on which none of the arc-shaped groove 4*c*, the groove 4*a*, and the ribs 4*b* is formed varies from material to material of which the closing film 4 is made, it is preferable that the thickness is from 0.2 to 1 mm. This is because too large thickness results in an increase in a penetration resistance and too small thickness makes molding of the film difficult by using an intrusion molding method.

When the insertion member 10 (see FIG. 4) is a general male luer, it is preferable that the silt 2*a* has a length $L_0$ of from 2.0 to 4.5 mm in terms of the insertion capability and liquid-tightness of the valve 2. It is preferable that the ratio between an outer diameter $D_2$ of the valve 2 and the length $L_0$ of the slit satisfies $1.1 \leqq D_2/L_0 \leqq 4$.

As shown in FIG. 2, it is preferable that the valve 2 has a thickness $L_i$ of from 1 to 2 mm in terms of the non-return effect, cost efficiency, and the like. The valve 2 may be made of a rubber-like elastic material. More restrictively, a material with a hardness JIS-A of 20 to 55 is preferable. Specific examples of the material include synthetic rubbers such as a silicone rubber, a natural rubber, a butyl rubber, and a nitrile rubber, a thermoplastic elastomer, and the like.

It is preferable that the end surface of the tubular body 3 in contact with the valve 2 is provided with an annular rib 32 that is formed circularly along the inner periphery of the tubular body 3. In this manner, when the annular rib 32 is formed on the end surface, it is possible to prevent liquid leakage between the valve 2 and the tubular body 3 when the insertion member 10 (see FIG. 4) is inserted into the slit 2*a* to pierce through the dosing film 4 and to communicate with the tubular body 3.

As shown in FIG. 4, the insertion member 10 inserted into the slit 2*a* can be engaged with the cover 5 by being fitted in a fitting hole 52 formed at the center of the cover 5, for example. In this case, the insertion member 10 can be engaged with the communication member 1 with a simple configuration.

In the case where the insertion member 10 is a male luer with a 6/100 tapered surface as defined by the international standard (ISO594-1), it is preferable that the fitting hole 52 has a diameter $D_1$ of from 3.9 to 4.4 mm (see FIG. 1) and a depth $L_2$ of from 0.3 to 1.0 mm (see FIG. 2).

It is preferable that the cover member 5 has a sufficient strength so that the cover 5 is not cracked even when the insertion member 10 is fitted tightly in the fitting hole 52. On this account, it is preferable that the cover 5 is made of polyacetal, polypropylene, polyimide, polyethylene terephthalate, polybutylene terephthalate, or the like, for example.

As shown in FIG. 1, it is preferable that $1.1 \leqq D_2/L_0 \leqq 4$ is satisfied in terms of ease of insertion of the insertion member 10 into the insertion hole 2*a*, the non-return effect, and the like. When the length $L_0$ of the insertion hole 2*a* is too long, i.e., $D_2/L_0$ is smaller than 1.1, it is feared that the valve is deformed and broken (torn) by inserting the insertion member 10 into the insertion hole 2*a*. In addition, a peripheral portion of the valve that is deformable (when the insertion member is inserted into the insertion hole) becomes smaller with respect to the insertion hole 2*a*, resulting in difficulty in inserting the insertion member 10 into the insertion hole 2*a*. On the other hand, when $D_2/L_0$ is larger than 4, it becomes easier to insert the insertion member 10 into the valve. However, the valve, the cover member 5, and the like become larger, resulting in a cost increase.

A description will be given of the relationship between the length $L_0$ of the slit (see FIG. 1) as the insertion hole 2*a* and the insertion member 10 (see FIG. 4). As shown in FIG. 4, it is assumed that in a state where the insertion member 10 is engaged with the fitting hole 52, a maximum diameter of a portion of the insertion member 10 that is buried in the valve 2 in contact therewith is an insertion portion diameter $D_3$. In this case, it is preferable that the length $L_0$ of the slit (see FIG.

1) is 0.7 times or more and 1.1 times or less the insertion portion diameter $D_3$. When $L_0$ is smaller than this range, it becomes difficult to insert the insertion member 10. When $L_0$ is larger than this range, air easily leaks from the insertion hole 2*a* when the insertion member 10 is extracted from the insertion hole 2*a*.

Although the above description has illustrated an example of the groove 4*c* being formed on the surface of the closing film 4 on the valve 2 side, and the ribs 4*b* being formed on the opposite surface, the ribs 4*b* may be formed on the surface of the dosing film 4 on the valve 2 side and the groove 4*a* may be formed on the opposite surface. When forming the arc-shaped groove 4*a* in this case, the arc-shaped groove 4*a* is formed on the periphery of the surface of the dosing film 4 on which the groove 4*a* is formed.

Further, although the above description has illustrated one example of the communication member of the present invention with reference to an example of the pair of ribs being formed along one straight line that passes through the center of the closing film, the communication member of the present invention is not limited to such a configuration. As long as the stress concentrates at the center X, the pair of ribs may be formed respectively along separate straight lines that pass through the center of the closing film.

Although the above description has illustrated one example of the communication member of the present invention with reference to an example of including two ribs, the communication member of the present invention is not limited to such a configuration. The communication member of the present invention may include three or more ribs. As long as one of the pair of ribs that are selected from the three or more ribs is formed on one of the two areas that are divided by the straight line whose longitudinal direction is the same as that of the groove and that passes through the center of the closing film, and the other rib is formed on the other area, it is within the scope of the present invention. Also in this case, it is further preferable that the tips of the ribs are coupled to each other at the center of the dosing film.

Figure 12:
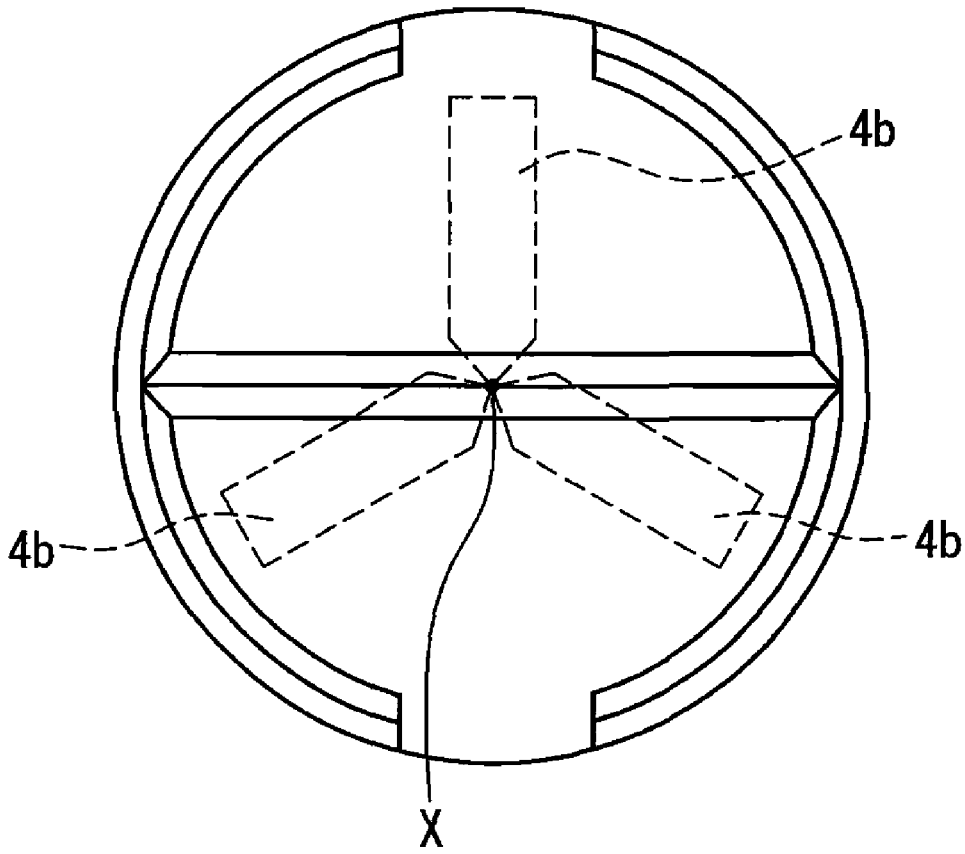
FIG. 12 is an enlarged plan view showing yet another example of the dosing film constituting the communication member shown in FIG. 1 from the valve side.

Further, as shown in FIG. 12, in one example of the communication member of the present invention, a plurality of the ribs 4*b* are formed. It is preferable that a tip of an end of each of the ribs 4*b* closer to the center of the closing film is in the vicinity of the center X of the dosing film, or is located at the center X, each of the ribs 4*b* is formed along a straight line that passes through the center X of the dosing film, and the plurality of the ribs 4*b* are disposed in a circumferential direction of the closing film at an equal angular interval. Also in this case, it is further preferable that the tips of the ribs are coupled to each other at the center of the dosing film.

The number of the groove 4*a* is not limited to one and two or more of the grooves 4*a* that intersect with each other at the center X may be formed.

Embodiment 2

In Embodiment 2, one example of a medical container using the communication member according to Embodiment 1 will be described with reference to FIG. 8.

As shown in FIG. 8, the medical container 100 according to the present embodiment includes: the container body 30; and the communication member 1 according to Embodiment 1 that is fixed to the container body 30 and allows communication between the inside and the outside of the container body 30.

The material of the container body 30 is not particularly limited and examples of the material include a flexible sheet material. Examples of the sheet material include vinyl chloride resin, polyethylene, ethylene-vinyl acetate copolymer, polyester, polybutadiene, polypropylene, polyamide, ethylene-methacrylate copolymer, polyethylene terephthalate, nylon (trade name) and the like. The thickness of the sheet material 2 is also not limited, and the thickness of, for example, about from 0.1 to 0.4 mm is suitable.

The shape of the container body 30 is also not particularly limited, and the container body 3 may be, for example, rectangular, elliptical, and the like. It is preferable that the lower side of the container body 30 is inclined slightly toward the communication member 1 so that the drug solution or the like present in the medical container 100 can flow easily into the communication member 1.

The method of fixing the communication member 1 to the container body 30 is not particularly limited and a conventionally-known method may be used.

As described above, according to the present invention, it is possible to provide a communication member for a medical container that can prevent the contamination of a drug solution with chips and accidental punctures, has excellent stability in storing the drug solution or the like, can be produced easily, and can communicate with an insertion member with an adequate force; and a medical container using the communication member.

INDUSTRIAL APPLICABILITY

The communication member for a medical container of the present invention can prevent contamination of a drug solution with chips and accidental punctures when used as a component of a medical container. Further it is possible to ensure stability in storing the drug solution or the like. Furthermore, since it can be produced easily and can communicate with an insertion member with an adequate force, it is suitable as a communication member of a medical container.

The invention claimed is:

1. A communication member for a medical container capable of allowing communication between an inside and an outside of a container body containing a liquid in a state of being fixed to the container body, the communication member comprising:

a disc-shaped valve having an insertion hole;

a tubular body supporting the valve; and a closing film for closing a bore of the tubular body positioned in the bore and in the vicinity of the valve, wherein the tubular body and the closing film are molded integrally, a groove that passes through a center of the closing film is formed on either a surface of the closing film on a valve side or a surface opposite to the valve side, a pair of ribs are formed on a surface opposite to a surface of the closing film on which the groove is formed, one of the pair of ribs is formed on one of the two areas that is divided by a straight line whose longitudinal direction is same as that of the groove and which passes through the center of the closing film, and the other rib is formed on the other area between both end portions of each of the ribs, a tip portion of an end portion that is closer to the center of the closing film has a width that decreases as it gets closer to a tip, the tips of the pair of ribs are coupled to each other at the center of the closing film, and communication between the inside and the outside of the container body is established by an insertion member inserted in the insertion hole piercing through the closing film.

2. The communication member for a medical container according to claim 1, wherein each of the pair of ribs is formed along a straight line that passes through the center of the closing film and has a predetermined angle with respect to the longitudinal direction of the groove.

3. The communication member for a medical container according to claim 1, wherein the groove has a width that decreases as it gets closer to a bottom.

4. The communication member for a medical container according to claim 1 further includes a cover member that interposes the valve together with the tubular body and covers a periphery of an outer surface of the valve.

5. The communication member for a medical container according to claim 1, wherein the pair of ribs are formed symmetrically with respect to the center of the closing film.

6. The communication member for a medical container according to claim 1, wherein the tip of each of the ribs is on a straight line whose longitudinal direction is the same as that of each of the ribs and that passes through the center of the closing film.

7. The communication member for a medical container according to claim 1, wherein the pair of ribs are both formed along one straight line that passes through the center of the closing film and has a predetermined angle with respect to the longitudinal direction of the groove.

8. The communication member for a medical container according to claim 7, wherein the straight line is orthogonal to the longitudinal direction of the groove.

9. The communication member for a medical container according to claim 1, wherein the closing film and the tubular body include at least one type of resin selected from a group consisting of polyethylene, polypropylene, cyclic polyolefin, polyethylene terephthalate, and polyvinyl chloride.

10. The communication member for a medical container according to claim 1, wherein one or more arc-shaped grooves are formed on the periphery of the surface of the closing film on which the groove is formed.

11. The communication member for a medical container according to claim 10, wherein at least one of the one or more arc-shaped grooves is coupled to the groove.

12. The communication member according to claim 1, wherein a plurality of ribs are formed on the surface opposite to the surface of the closing film on which the groove is formed, each of the ribs is formed along a straight line that passes through the center of the closing film and has a predetermined angle with respect to a longitudinal direction of the groove, and the plurality of ribs are disposed at an equal angular interval in a circumferential direction of the closing film.

13. A medical container comprising:

a container body;

the communication member according to claim 1 being fixed to the container body and allowing communication between the inside and the outside of the container body; and a liquid present in the container body.

14. The medical container according to claim 1, wherein the closing film and the tubular body are made of rigid plastic.

* * * * *